US005273450A

United States Patent [19]

Renn et al.

[11] Patent Number: 5,273,450

[45] Date of Patent: Dec. 28, 1993

[54] MECHANICAL AND ELECTRICAL CLAMPING MECHANISMS BETWEEN A "MOTHER" BOARD AND A "DAUGHTER" BOARD IN AN ELECTRONIC ASSEMBLY

[75] Inventors: Robert M. Renn, Pfafftown; David C. Johnson, Winston Salem; Keith L. Volz, Jamestown; Frederick R. Deak, Kernersville; Warren A. Bates, Winston Salem, all of N.C.; Douglas M. Walburn, Harrisburg, Pa.

[73] Assignee: The Whitaker Corporation, Wilmington, Del.

[21] Appl. No.: 938,989

[22] Filed: Sep. 1, 1992

[51] Int. Cl.[5] ..... H01R 13/15

[52] U.S. Cl. ..... 439/260; 439/328; 439/66

[58] Field of Search ..... 439/259-265, 439/629-637, 65, 66, 91, 327, 328

[56] References Cited

U.S. PATENT DOCUMENTS

| | | | |
|---|---|---|---|
| 3,084,302 | 4/1963 | Braeutigam | 439/328 |
| 3,795,884 | 3/1974 | Kotaka | 439/66 |
| 4,270,826 | 6/1981 | Narozny | 439/260 |
| 4,640,562 | 2/1987 | Shoemaker | 439/327 |
| 4,695,108 | 9/1987 | Ichitsubo | 439/327 |
| 4,737,120 | 4/1988 | Grabbe et al. | 439/328 |

*Primary Examiner*—Larry I. Schwartz
*Assistant Examiner*—Hien D. Vu
*Attorney, Agent, or Firm*—William B. Noll

[57] ABSTRACT

A connector body (10 10', 10'') is mounted on a mother board (11) and has a compressible electrical connector (15). A daughter board (22) is slidably inserted into the connector body (10, 10', 10'') perpendicularly of the mother board (11). A deflection means (34, 56) engages a side of the daughter board (22) and deflects the daughter board (22) away from the compressible electrical connector (15) to prevent damage thereto after the daughter board (22) is slidably inserted. When the daughter board (22) is fully inserted, a retaining means 28, 43, 69) exerts a lateral clamping force on the daughter board (22).

10 Claims, 10 Drawing Sheets

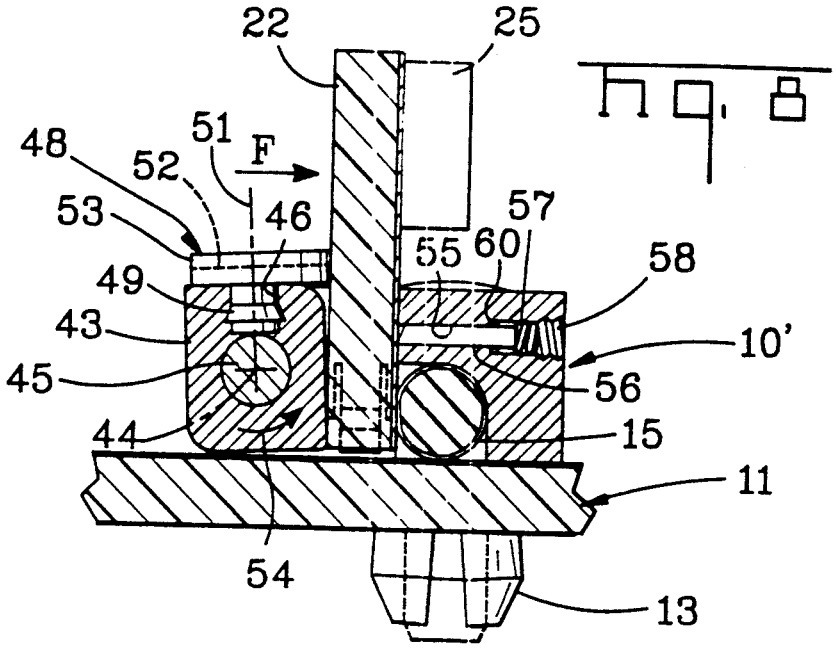
Fig. 8
Fig. 9
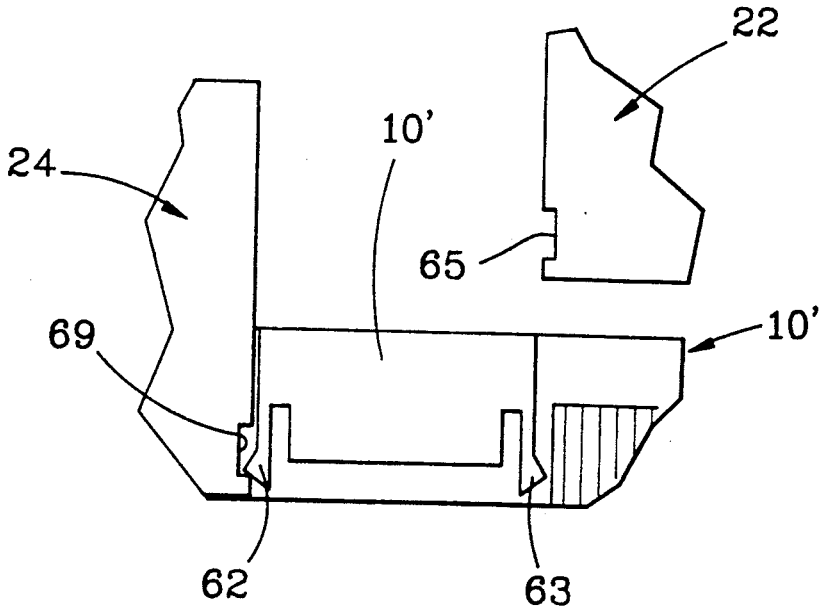

MECHANICAL AND ELECTRICAL CLAMPING MECHANISMS BETWEEN A "MOTHER" BOARD AND A "DAUGHTER" BOARD IN AN ELECTRONIC ASSEMBLY

The present invention relates to clamping mechanisms between electronic assemblies having respective circuit elements electrically connected therebetween, and more particularly, to mechanical and electrical clamping mechanisms between a "mother" board and a "daughter" board, one of which has one or more flexible or compressible electrical connectors.

BACKGROUND OF THE INVENTION

A mother board and one or more daughter boards are used to transfer digital signals between respective assemblies used in a computer or other electronic equipment. The mother and daughter boards may be arranged perpendicular to each other, as in an "edge card" configuration, depending upon the design of the overall product.

In a variety of other product applications, the prior art has used compressible electrical connectors which are well known in the electronic industry. These compressible electrical connectors include a plurality of closely-spaced conductive elements or traces photographically etched or otherwise formed on a flexible film which is bonded to an elastomeric core or other suitable carrier. Under its trademark "AMPLIFLEX", AMP Incorporated of Harrisburg, Pa., supplies a wide variety of such compressible electrical connectors to the electronic and aerospace industries.

Because of their relatively-high circuit densities, it would be desirable to use these "AMPLIFLEX" compressible electrical connectors in certain product applications having mother/daughter board configurations. However, because the daughter board is slidably inserted into the mother board, perpendicularly thereof, the compressible electrical connector may become damaged inadvertently.

It is important, therefore, to have a very low or substantially zero insertion force (sometimes called the "ZIF") to preclude damage to the compressible electrical connector. This is required for insertion of the boards during assembly of the equipment in production as well as withdrawal of the boards during maintenance and service of the equipment in the field.

SUMMARY OF THE INVENTION

The present invention provides superior clamping mechanisms to assure good mechanical and electrical connections between a mother board and a daughter board, thereby preventing damage to the compressible electrical connectors.

The clamping mechanisms of the present invention have very low insertion force or substantially zero insertion force, high assembly speed, high circuit density, and quick connect and release for desired interchangeability in manufacture and service of the equipment.

In accordance with the teachings of the present invention, there is disclosed herein a preferred embodiment of an electrical assembly including a mother board, a connector body mounted on the mother board, and at least one compressible electrical connector carried by the connector body. A daughter board is slidably inserted within the connector body and is disposed substantially perpendicularly to the mother board. The daughter board has respective sides and further has respective circuit elements electrically connected to the compressible electrical connector on the connector body. A deflection means is carried by the connector body and engages one of the sides of the daughter board to deflect the daughter board away from the compressible electrical connector as the daughter board is slidably inserted into the connector body. This precludes engagement of the daughter board with the compressible electrical connector, thereby providing a substantially zero insertion force, and thereby precluding potential damage to the compressible electrical connector upon insertion of the daughter board. A retaining means is mounted on the connector body and exerts a lateral clamping force on the daughter board and against the connector body, after the daughter board has been inserted into the connector body, thereby removably retaining the daughter board on the mother board.

The deflection means may comprise a right-angularly bent deflection plate or a resiliently-biased slide plate; and the retaining means may comprise a wedge slidably received in the connector body or a pivoting force member pivotably mounted on the connector body and actuated by an eccentric cam carried thereon.

These and other objects of the present invention will become apparent from a reading of the following specification taken in conjunction with the enclosed drawings.

BRIEF DESCRIPTION OF DRAWINGS

FIG. 8 is a still further cross-sectional view, corresponding substantially to that of FIG. 7, but showing the daughter board fully inserted into the connector body, and further showing the eccentric cam rotated in one direction to pivot the pivoting force member to thereby exert a lateral clamping force on the daughter board and against the connector body.

FIG. 9 is a view, partly in section and partly in exploded relationship, showing a pair of inwardly-projecting oppositely-directed hooks formed on the connector body and engaging respective recesses formed in an intermediate portion of the daughter board (as well as on the respective ends thereof).

DETAILED DESCRIPTION OF THE PREFERRED EMBODIMENTS

Figure 1:
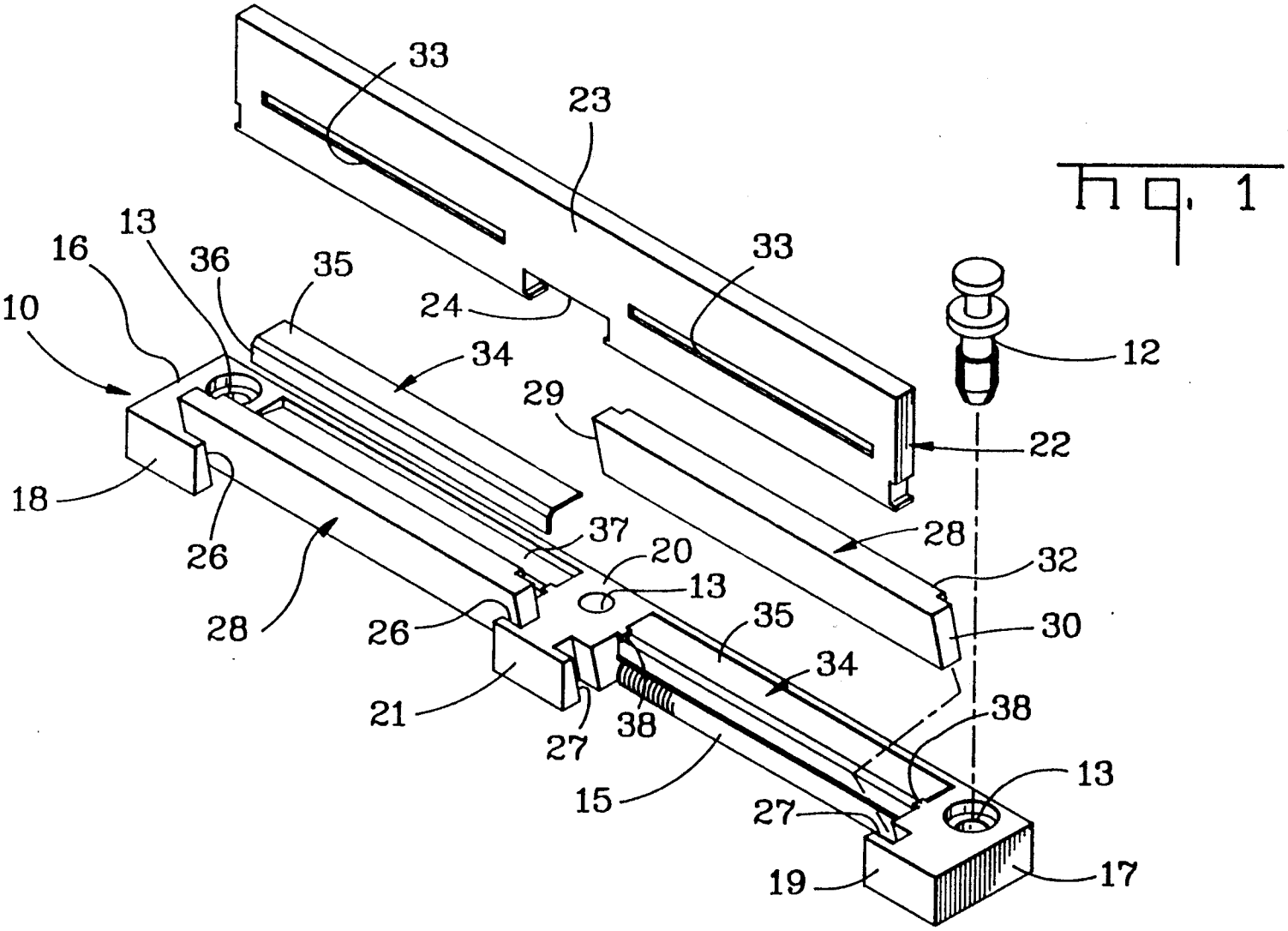
FIG. 1 is an exploded perspective of a first embodiment of the present invention, showing a connector body having respective spaced-apart compressible electrical connectors, a daughter board intended to be slidably inserted within the connector body and nested partially therein, respective deflection members engaging one side of the daughter board and deflecting the daughter board away from the compressible electrical connectors during slidable insertion of the daughter board into the connector body, and retaining members received in respective angled slots in the connector body for exerting a lateral clamping force on the other side of the daughter board.

With reference to FIGS. 1-4, showing a first embodiment of the invention, a connector body 10 is secured to a mother board 11 by a plurality of fasteners 12 received in respective mounting hole 13 in the connector body 10. The connector body 10, which is preferably molded from a suitable material, has at least one recess 14 receiving a flexible or compressible electrical connector 15.

Preferably, there are two compressible electrical connectors 15 received in corresponding spaced-apart recesses 14, although the teachings of the present invention are equally applicable to any member of compressible electrical connectors 15 carried by the connector body 10 and, thus, by the mother board 11. The compressible electrical connectors 15 are supported at their respective ends on the connector body 10, and the length of each compressible electrical connector 15 is a few inches (preferably a maximum of two inches) to prevent bowing or distortion of the compressible electrical connector 15 intermediate its ends.

Each compressible electrical connector 15 comprises a thin flexible film wrapped around an elastomeric core, bonded thereto, and terminating in a "tail". The thin flexible film has a plurality of circuit elements or traces photographically etched thereon, as for example, traces which are 1.5 mil wide and on 3.0 mil centers. The elastomeric core, which may be of silicone rubber or other suitable material, has a substantially round cross-section (as shown in the drawings) although the teachings of the invention are equally applicable to an oval or other cross-sectional shape. Further details of the compressible electrical connector 15, being conventional, have been omitted for ease of illustration.

The connector body 10 has a pair of respective end portions 16 and 17. End portion 16 has a first laterally-extending boss 18, and end portion 17 has a second laterally-extending boss 19. The connector body 10 further has an intermediate portion 20 provided with a third laterally-extending boss 21.

A daughter board 22, which is substantially oblong, has an intermediate portion 23 provided with a notch 24 for receiving the third (intermediate) boss 21 on the daughter board 22, thereby nesting the daughter board 22 with respect to the connector body 10. The daughter board 22 is disposed substantially at right angles (perpendicularly) to the mother board 11, and the daughter board 22 has respective circuit elements (one of which is shown at 25) for electrical connection with the compressible electrical connector 15 on the connector body 10.

A first pair of angled slots 26 is formed between the first and third laterally-extending bosses 18 and 21, respectively, and a second pair of angled slots 27 is formed between the second and third laterally-extending bosses 19 and 21, respectively.

The retaining means includes a wedge 28 having respective ends 29 and 30 slidably received in each pair of angled slots 26 and 27, respectively. The wedge 28, which may be molded from a suitable plastic or other material, has a longitudinally-extending protrusion 31 engaging the side of the daughter board 22 opposite from the connector body 10 (as shown more clearly in FIG. 4). Each wedge 28 further has a longitudinally-extending hook 32 received within a longitudinally-slotted recess 33 in the daughter board 22.

When the wedge 28 is fully seated within the angled slots 26 and 27, the wedge 28 exerts a lateral clamping force on the daughter board 22 and against the connector body 10 and, thus, against the mother board 11 to which the connector body 10 is secured.

Figure 2:
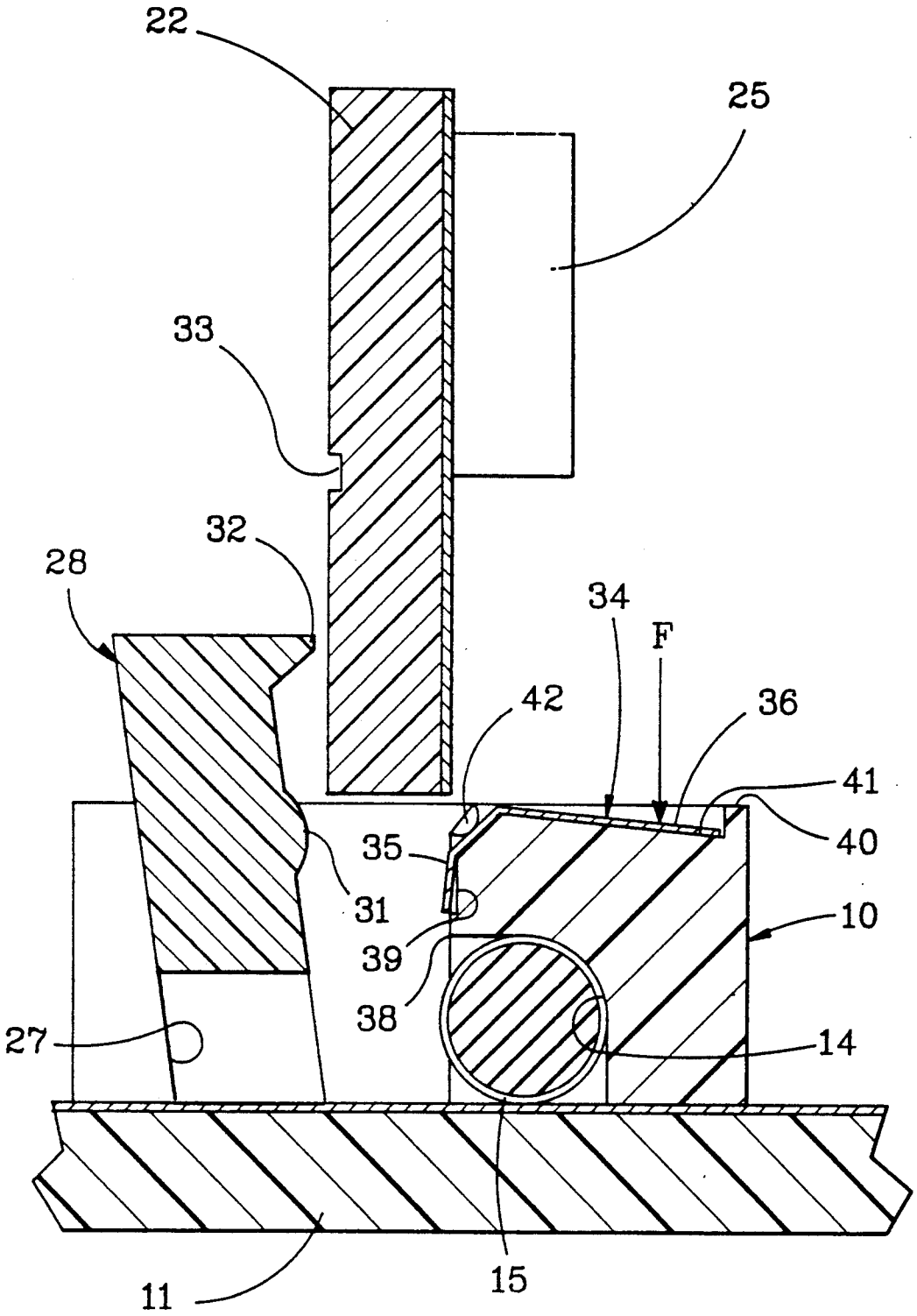
FIG. 2 is a cross-sectional view of the components of FIG. 1 in their pre-assembled relationship, showing the daughter board to be inserted into the connector body, the compressible electrical connector in the connector body, and a wedge to be slidably inserted into respective angled slots in the connector body.

A right-angularly bent deflection plate 34 has a pair of legs 35 and 36 joined by and intermediate section 37, the intermediate section 37 having respective longitudinally-spaced edge portions. The connector body 10 has an inner side wall 38 provided with a first recess 39 adjacent to the one leg 35 of the deflection plate, such that the one leg 35 normally extends outwardly of the first recess 39. The connector body further has a top surface 40 provided with a tapered second recess 41 for receiving the other leg 36 of the deflection plate, such that the other leg is normally received in the second recess 41. A pair of longitudinally-spaced projections 42 is formed on the connector body 10. These projections 42 (one of which is shown in FIG. 2) confront one another and engage the respective longitudinal-spaced edge portions of the intermediate section 37 of the deflection plate 34, thereby pivotably mounting the deflection plate 34 on the connector body 10.

Figure 3:
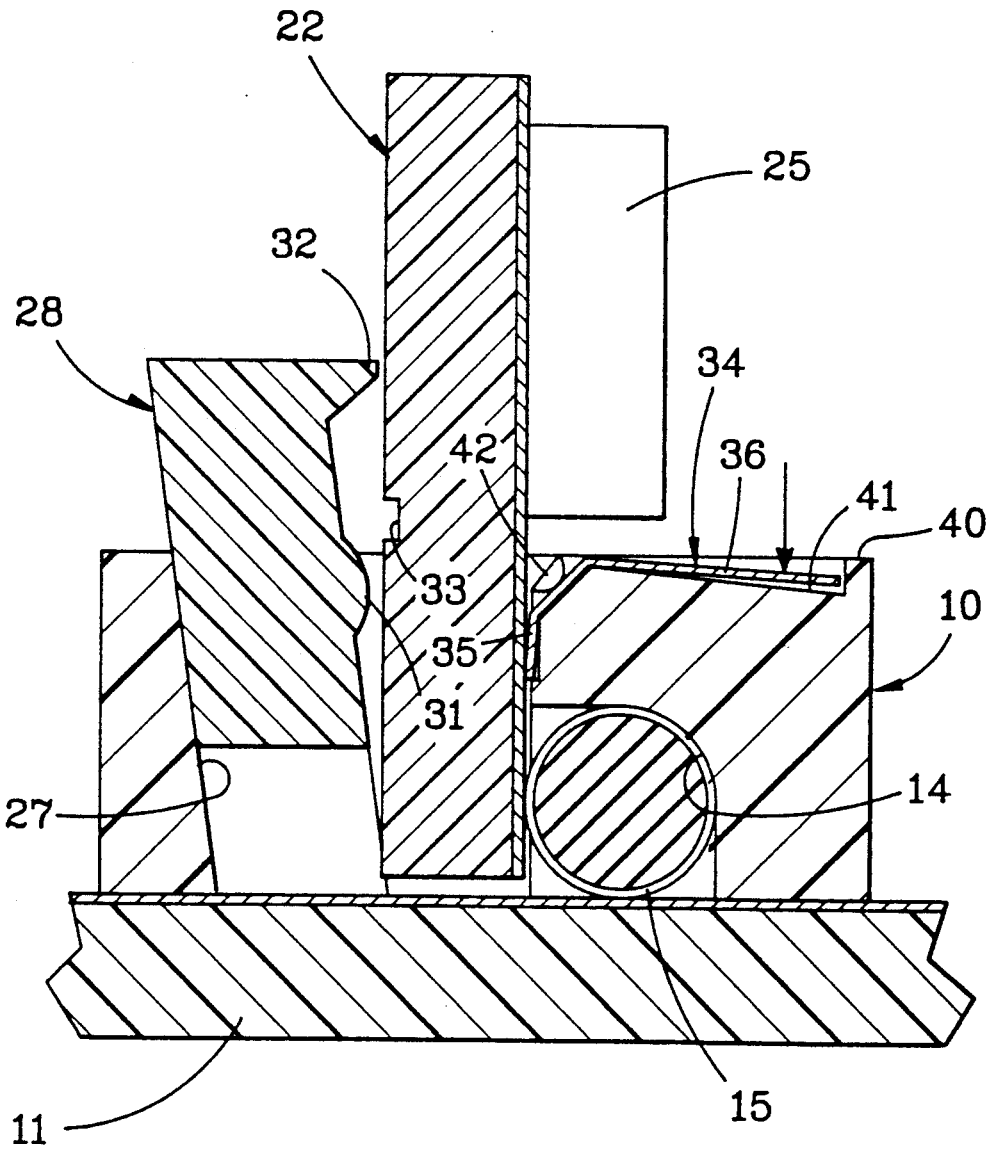
FIG. 3 is a further cross-sectional view, corresponding substantially to that of FIG. 2, but showing the deflection plate engaging one side of the daughter board and deflecting the daughter board away from the compressible electrical connector as the daughter board is slidably inserted into the connector body.
Figure 4:
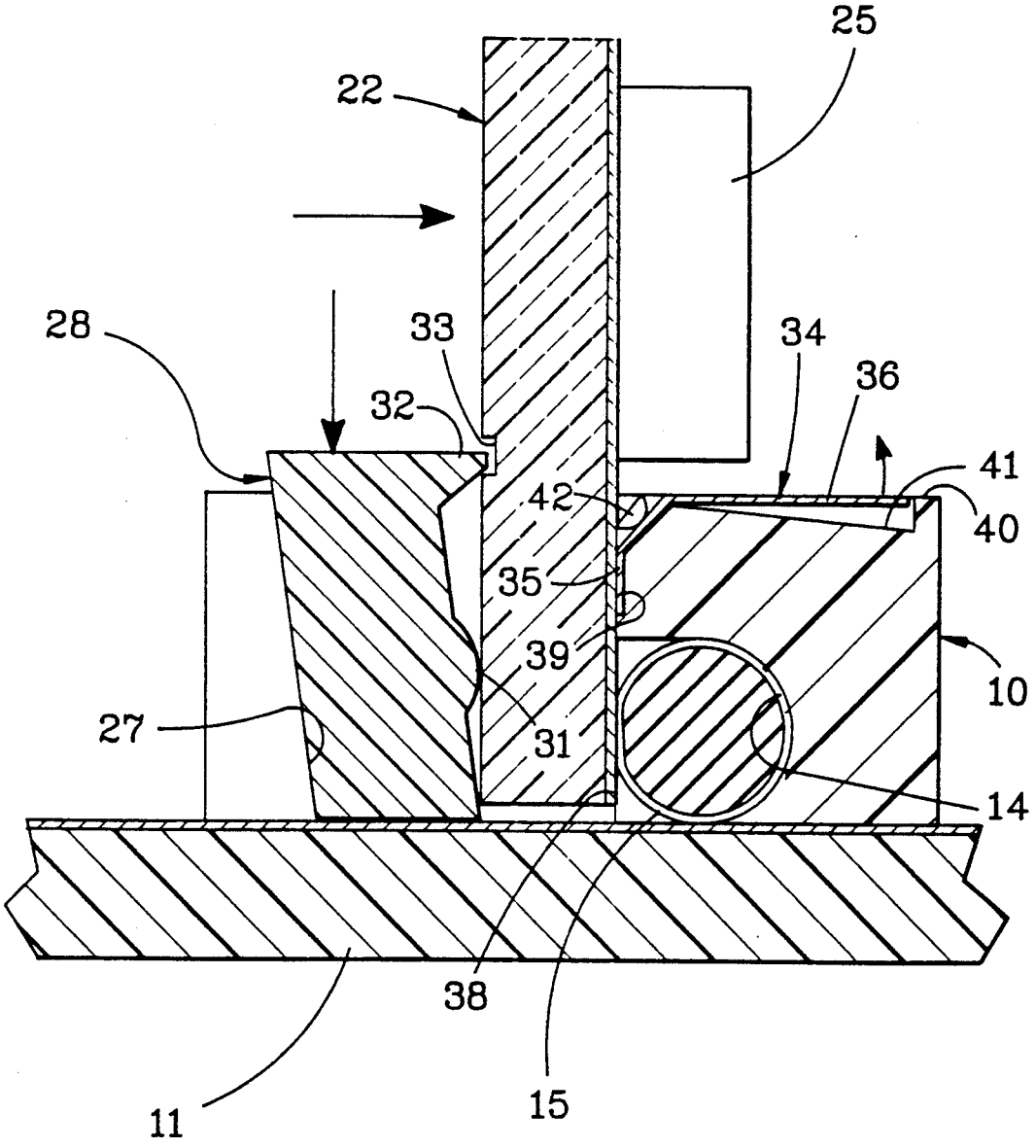
FIG. 4 is a still further cross-sectional view, showing the wedge slidably inserted into its angled slots to exert a lateral clamping force on the daughter board and against the connector body.
Figure 5:
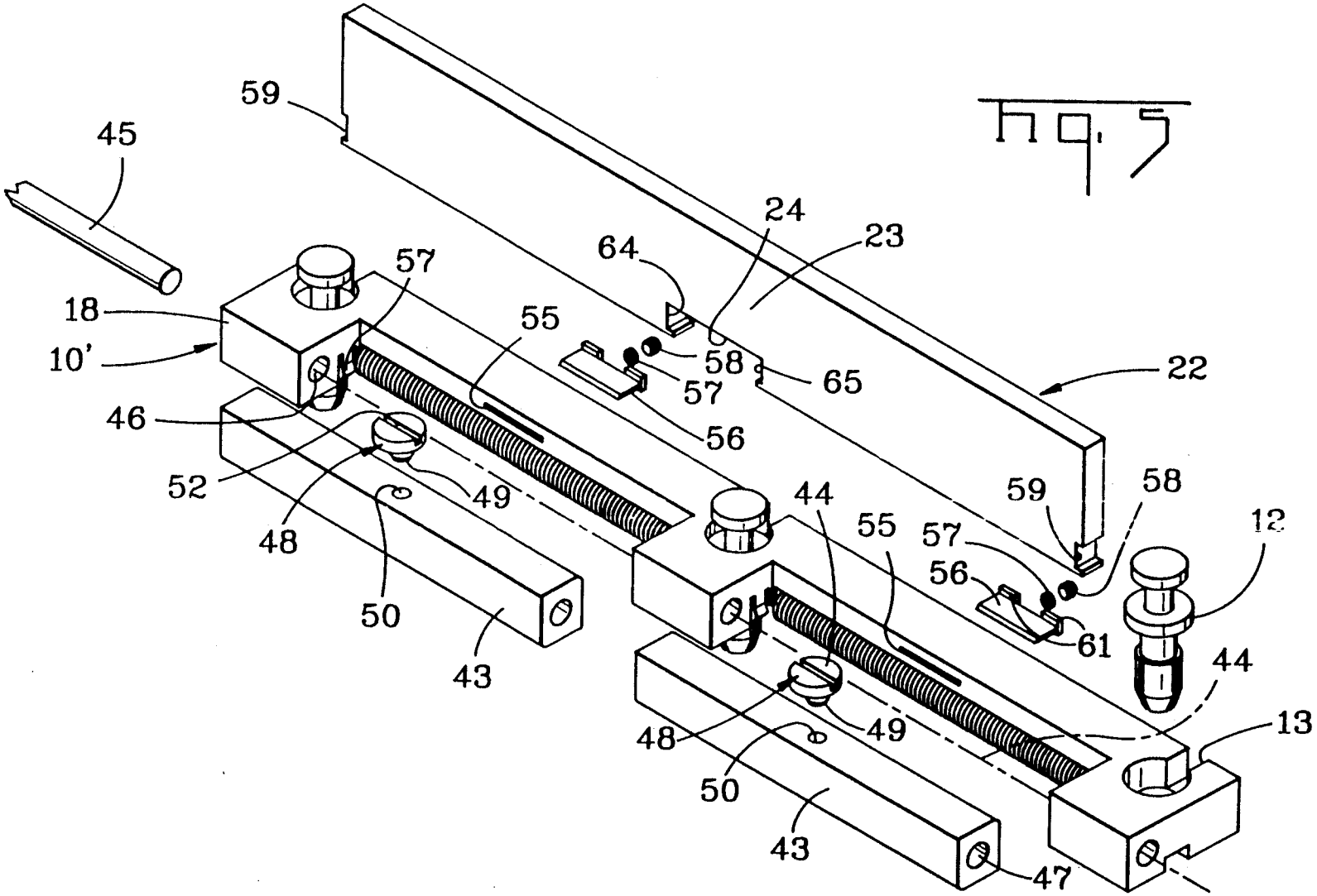
FIG. 5 is an exploded view of a second embodiment of the present invention, corresponding substantially to that of FIG. 1, but showing a pair of pivoting force members, each of which is provided with an eccentric cam.
Figure 6:
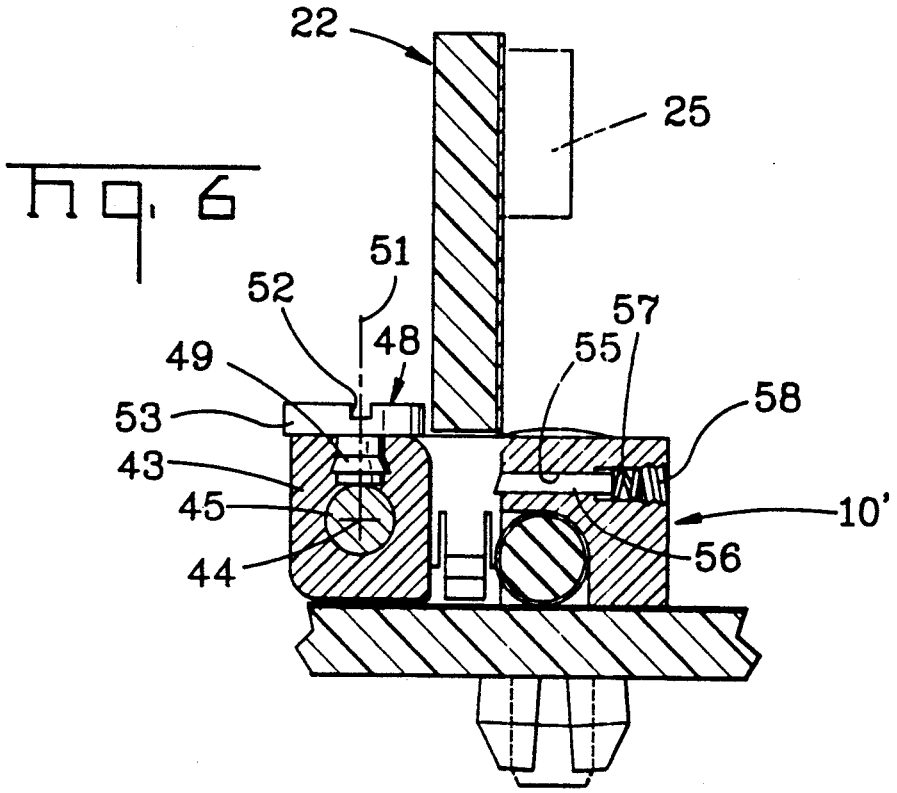
FIG. 6 is a cross-sectional view of the components of FIG. 5 in their pre-assembled relationship, showing the daughter board about to be inserted into the connector body.
Figure 7:
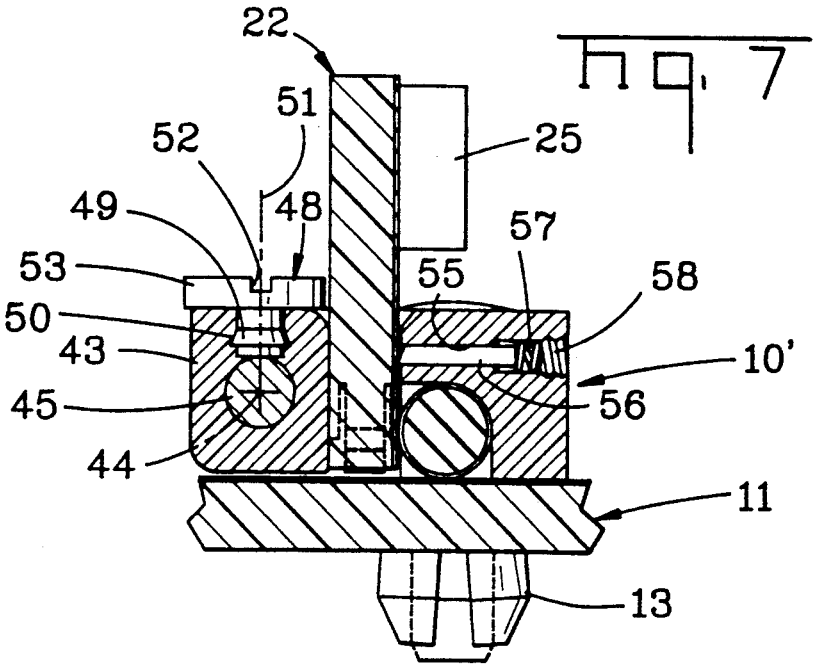
FIG. 7 is a further cross-sectional view, corresponding substantially to that of FIG. 6, but showing the resiliently-biased slide plate in the connector body engaging the daughter board and deflecting the daughter board away from the compressible electrical connector in the connector body.
Figure 10:
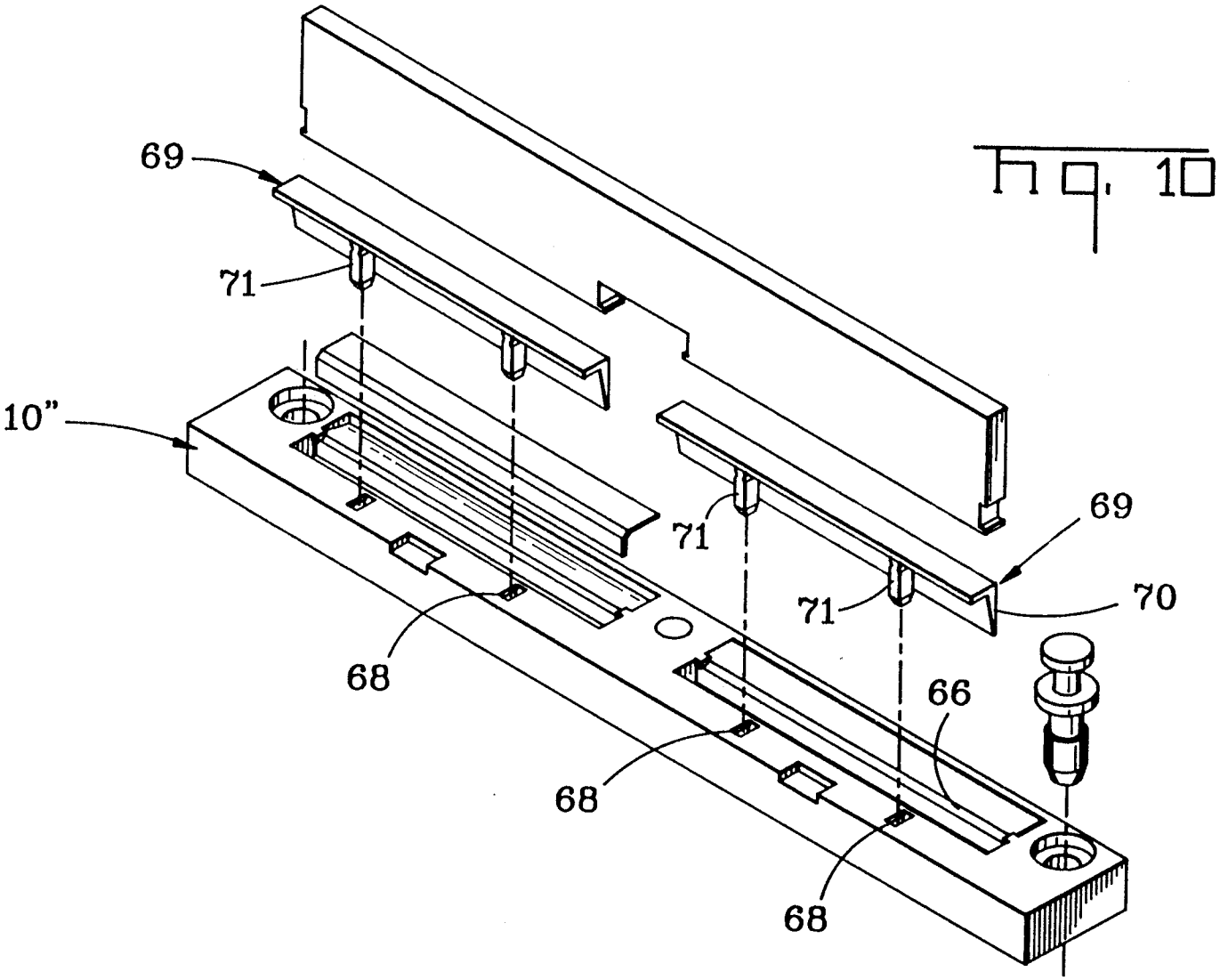
FIG. 10 is an exploded perspective of a third embodiment of the present invention, showing a retaining member.
Figure 11:
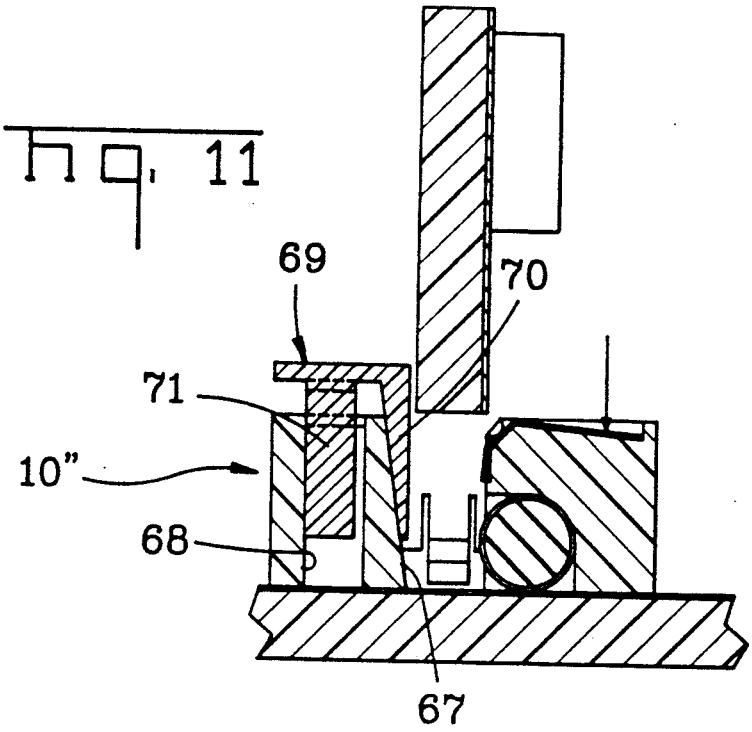
FIG. 11 is a cross-sectional view of the components of FIG. 10 in their pre-assembled relationship, showing the daughter board to be inserted into the connector body, and further showing a retaining member with its longitudinally-extending tapered wedge engaging an inner angled side wall on the connector body.
Figure 12:
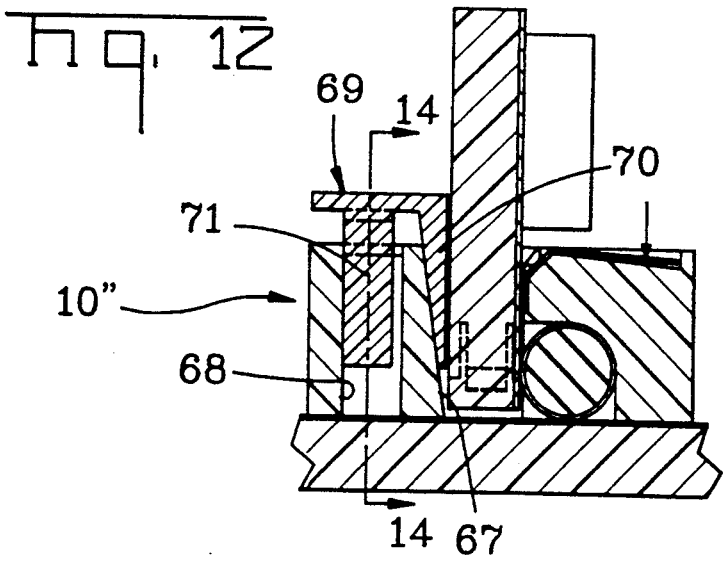
FIG. 12 is a further cross-sectional view, corresponding substantially to that of FIG. 11, and showing the deflection plate on the connector body engaging the daughter board and deflecting the daughter board away from the compressible electrical connector as the daughter board is slidably inserted into the connector body.
Figure 13:
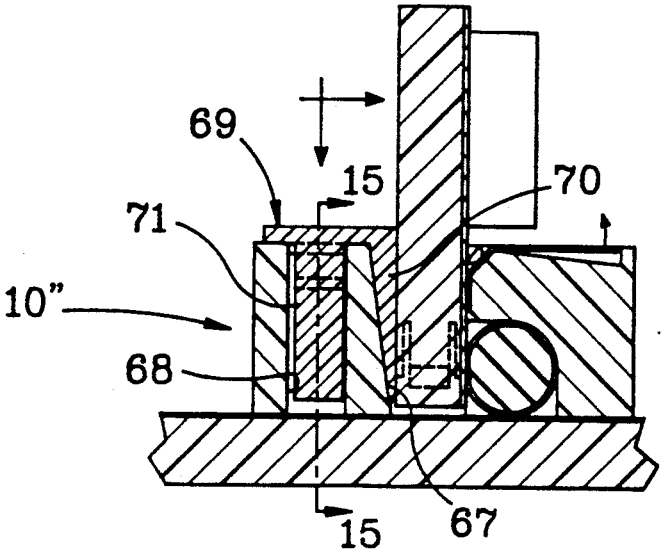
FIG. 13 is a still further cross-sectional view, corresponding substantially to that of FIG. 12, but showing the retaining member pushed down on the connector body so that the wedge on the retaining member exerts a lateral clamping force on the daughter board.

When the daughter board 22 is slidably inserted into the connector body 10, the daughter board 22 engages the one leg 35 of the deflection plate 34, thereby pivoting the deflection plate 34 slightly, such that the one leg 35 is partially received in the first recess 39, and such that the other leg 36 is lifted partially out of the second recess 41 (as shown more clearly in FIG. 3). More significantly, the one leg 35 of the deflection plate 34 deflects the daughter board 22 away from the compressible electrical connector 15, thereby preventing the compressible electrical connector 15 from being damaged by the slidable insertion (or withdrawal) of the daughter board 22 with respect to the connector body 10.

With reference to FIGS. 5–8, a second embodiment of the invention is shown, wherein like numerals have been used to designate the components similar to, or identical with, the components of FIGS. 1–4.

In this second embodiment, a pivoting force member 43 is pivotably mounted between the first boss 18 and the third boss 20, and between the second boss 19 and the third boss 20, respectively, on a connector body 10'. The pivoting force member 43, which may be molded from a suitable material, is mounted about a pivot axis 44. Any suitable means may be employed for pivotably mounting the pivoting force member 43, such as a pivot pin 45 received through a bore 46 in the first boss 18 and into a bore 47 in the pivoting force member 39.

An eccentric cam 48 has a stem 49 trapped within a recess 50 in the pivoting force member 43 and rotatable therein about an axis 51 which is substantially perpendicular to, and preferably intersects, the pivot axis 44 of the pivoting force member 43. Rotation of the eccentric cam 48 is facilitated by a slot 52 in its head 53 (or other suitable means).

When the eccentric cam 48 is rotated in one direction about its axis 51, the pivoting force member 43 is swung or pivots about its pivot axis 44 (as indicated by the arrow 54 in FIG. 8) to exert a lateral clamping force against the daughter board 22. Thus, the daughter board 22 is releasably clamped against the connector body 10' and, ultimately, against the mother board 11 to which the connector body 10' is removably secured.

The connector body 10' has a slotted recess 55 receiving a slide plate 56 backed up by a spring 57 and set screw 58. The resiliently-biased slide plate 56 extends partially into the opening in the connector body 10' for the daughter board 22. The connector body 10' further has an enlarged recess 59 formed therein (for the spring 57 and set screw 58) and this enlarged recess 59 opens outwardly of the connector body 10' and communicates with the slotted recess 55, thereby forming an internal ledge 60 between the slotted recess 55 and the enlarged recess 59. The slide plate 56 has a pair of oppositely-extending ears 61 resting on the internal ledge 60, thereby limiting the inward movement of the slide plate 56 into the opening in the connector body 10' for the daughter board 22.

When the daughter board 22 is slidably inserted into the connector body 10', the slide plate 56 deflects the daughter board 22 inwardly and away from the compressible electrical connector 15, thereby providing a substantially zero insertion force ("zif") and preventing inadvertent damage to the compressible electrical connector 15. Accordingly, the resiliently-biased slide plate 56 of FIGS. 5–8 provides the same function as the deflection plate 34 of FIGS. 1–4.

With reference to FIG. 9, the connector body 10' has a pair of oppositely-directed outwardly-projecting resilient hooks 62 and 63 engaging respective recesses 64 and 65, respectively, formed in the notch 24 in the intermediate portion 23 of the daughter board 22, thereby positively detenting the daughter board 22 with respect to the connector body 10'. A similar structure is used on the respective end portions of the daughter board 22 as shown partially in the exploded perspective views of FIGS. 1 and 5.

With reference to FIGS. 10–15, a third embodiment of the invention is shown, wherein like numerals have been used to designate the parts similar to, or identical with, the first and second embodiments of FIGS. 1–4 and 5–8, respectively.

In this third embodiment, a connector body 10" having an opening 66 for receiving the daughter board 22. The opening 66 has an angled or tapered side wall 67, and the connector body 10" further has at least one (and preferably a pair of) slotted mounting holes 68, each of which has a substantially rectangular cross-section.

A wedge 69 has a tapered portion 70 and further has at least one (and preferably a pair of) depending legs 71. Legs 71 are received in the respective slotted mounting holes 68 in the connector body 10", as the wedge 69 is snapped into the connector body 10", and as the tapered portion 70 of the wedge 69 bears against the angled side wall 67, to thereby exert a lateral clamping force against the side of the daughter board 22 and against the connector body 10".

Each depending leg 71 of the wedge 69 has a first pair of slotted recesses 72 and a second pair of slotted recesses 73 spaced therefrom (or therebelow). In turn, each slotted mounting hole 68 has a complementary first pair of protruding ribs 74 and a second pair of protruding ribs 75 spaced therefrom. The first pair of ribs 74 is substantially at the top of the slotted mounting hole 68, and the second pair of ribs 75 is within the slotted mounting hole 68.

Figure 14:
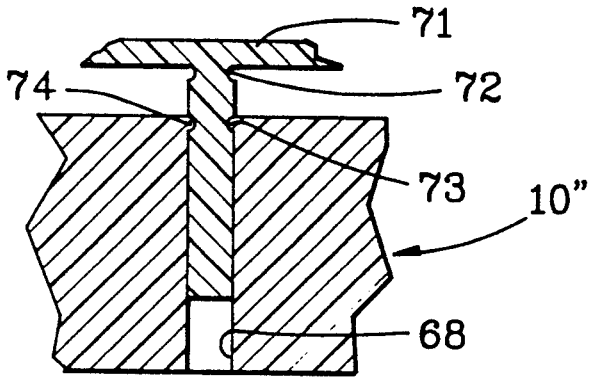
FIG. 14 is a cross-sectional view, taken along the lines 14-14 of FIG. 13, and showing one of the depending legs on the retaining member, spaced laterally of the wedge on the retaining member, and received in a slotted mounting hole in the connector body.
Figure 15:
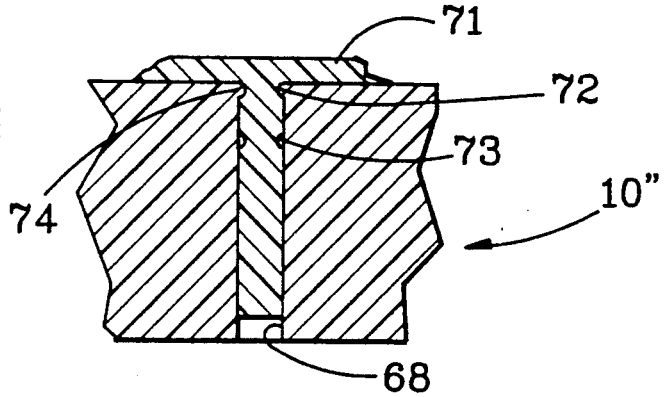
FIG. 15 is a cross-sectional view, taken along the lines 15—15 of FIG. 13 and corresponding substantially to that of FIG. 14, but showing the depending leg fully pushed down into the slotted mounting hole in the connector body.

As the wedge 68 is pushed down on to the connector body 10" and snapped thereto, the first pair of ribs 74 is first received in the second pair of slotted recesses 73; and as the wedge 69 is fully seated on the connector body 10", the first pair of ribs 74 is received in the first pair of slotted recesses 72, and the second pair of ribs 75 is received in the second pair of slotted recesses 73 as shown in FIGS. 14 and 15, respectively. In this assembly process, the depending leg 71 of the wedge 69 moves laterally within the slotted mounting hole 68 (as shown more clearly in FIGS. 12 and 13, respectively) as the wedge 69 mechanically clamps the daughter board 22.

As will be appreciated by those skilled in the art, this invention facilitates a member of product features and advantages, as follows: (1) low insertion force or zero insertion force ("zif") between the respective assemblies, (2) fast assembly of the components consonant with high circuit density, and (3) quick disconnect for easy maintenance and repair. There is no pressure on the compressible electrical connector until the electrical connection is made, and the compressible electrical connector may be on the mother board or on the daughter board depending upon customer preferences in their equipment packaging.

Obviously, many modifications may be made without departing from the basic spirit of the present invention. Accordingly, it will be appreciated by those skilled in the art that within the scope of the appended claims, the invention may be practiced other than has been specifically described herein.

We claim:

1. In an electrical assembly, the combination of:

a mother board, a connector body mounted on the mother board, at least one compressible electrical connector carried by the connector body, a daughter board slidably inserted within the connector body and disposed substantially perpendicularly to the mother board, the daughter board having respective sides and further having respective circuit elements electrically connected to the compressible electrical connector on the connector body, deflection means carried by the connector body and engaging one of the sides of the daughter board as the daughter board is slidably inserted into the connector body to deflect the daughter board away from the compressible electrical connector, thereby, precluding engagement of the daughter board with the compressible electrical connector, providing a substantially zero insertion force, and precluding potential damage to the compressible electrical connector, and retaining means mounted on the connector body and exerting a lateral clamping force on the other side of the daughter board after the daughter board has been inserted into the connector body, thereby removably retaining the daughter board on the mother board.

2. The combination of claim 1, wherein the deflection means comprises:

a right-angularly bent deflection plate having a pair of legs joined by an intermediate section, the intermediate section having respective longitudinally-spaced edge portions, the connector body having an inner side wall provided with a first recess adjacent to one of the legs of the deflection plate, such that the one leg normally extends outwardly of the first recess, the connector body further having a top surface provided with a second recess for receiving the other leg of the deflection plate, such that the other leg is normally received in the second recess, a pair of longitudinally-spaced projections formed on the connector body, confronting one another, and engaging the respective longitudinal-spaced edge portions of the intermediate section of the deflection plate, thereby pivotably mounting the deflection plate on the connector body, whereby, when the daughter board is slidably inserted into the connector body, the daughter board engages the one leg of the deflection plate, thereby pivoting the deflection plate, such that the one leg is partially received in the first recess, and such that the other leg is lifted out of the second recess, and whereby the one leg of the deflection plate deflects the daughter board away from the compressible electrical connector in the connector body.

3. The combination of claim 1, wherein the deflection means comprises:

the connector body having an opening formed therein for receiving the daughter board, the connector body further having a slotted recess formed therein, substantially perpendicularly of the opening in the connector body for the daughter board and communicating with the opening, a resiliently-biased slide plate received within the slotted recess and extending partially into the opening in the connector body for the daughter board, such that the slide plate engages the daughter board as the daughter board is slidably inserted into the opening in the connector body, thereby deflecting the daughter board away from the compressible electrical connector in the connector body.

4. The combination of claim 3, wherein:

the connector body has an enlarged recess formed therein, opening outwardly of the connector body, and communicating with the slotted recess, thereby forming an internal ledge between the slotted recess and the enlarged recess, the slide plate has a pair of oppositely-extending ears resting on the internal ledge, thereby limiting the inward movement of the slide plate into the opening in the connector body for the daughter board, a set screw is threadably received in the enlarged recess, and a spring is disposed in the enlarged recess between the set screw and the slide plate.

5. The combination of claim 1, wherein the retaining means comprises:

the connector body having at least a pair of bosses extending laterally away from the daughter board, the laterally-extending bosses each having a slot formed therein, the slots confronting each other and being angled with respect to the plane of the daughter board, and a wedge slidably received in the slots and engaging the daughter board.

6. The combination of claim 5, wherein:

the wedge has a protrusion formed thereon to engage the daughter board and exert the lateral clamping force thereon.

7. The combination of claim 6, wherein:

the wedge further has a hook formed thereon, the daughter board has a recess formed therein to receive the hook, thereby retaining the wedge.

8. The combination of claim 1, wherein the retaining means comprises:

the connector body having at least a pair of longitudinally-spaced bosses extending laterally away from the daughter board, a pivoting force member mounted about a pivot axis between the bosses, and an eccentric cam carried by the pivoting force member and rotatable thereon about an axis which is substantially perpendicular to the pivot axis of the pivoting force member, such that the eccentric cam may be rotated to pivot the pivoting force member against the daughter board.

9. The combination of claim 1, wherein the retaining means comprises:

the connector body having a longitudinally-extending inner side wall confronting the other side of the daughter board which is opposite to the deflection means, the inner side wall on the connector body being angled, such that the space between the inner side wall and the other side of the daughter board converge in the direction in which the daughter board is inserted into the connector body and towards the mother board, a retaining member having a longitudinally-extending tapered wedge engaging the angled inner side wall of the connector body, thereby exerting a lateral clamping force on the daughter board, and means for slidably mounting the retaining member on the connector body.

10. The combination of claim 9, wherein the connector body has a top surface, and wherein the means for slidably mounting the retaining member on the connector body comprises:

the connector body having at least one slotted mounting hole formed therein substantially parallel to the daughter board, the mounting hole having two pairs of inwardly-projecting ribs axially spaced from each other and including first and second pairs of ribs, the first pair of ribs being disposed substantially at the top surface of the connector body, and the second pair of ribs being disposed within the slotted mounting hole, and the retaining member having at least one depending leg slidably received in the slotted mounting hole, the depending leg having two pairs of recesses spaced from each other, corresponding to the two pairs of axially-spaced ribs in the slotted mounting hole, and including a first pair of recesses and a second pair of recesses forwardly thereof, such that when the depending leg on the retaining member is initially received in the slotted mounting hole in the connector body, the first pair of ribs in the slotted mounting hole is received in the second pair of recesses in the depending leg, and such that when the retaining member is pushed down on to the top surface of the connector body, the first pair of ribs in the slotted mounting hole is received in the first pair of recesses in the depending leg, and the second pair of ribs is received in the second pair of recesses in the depending leg, as the depending leg moves inwardly of the slotted mounting hole in the direction of the daughter board.

* * * * *